US009867442B1

(12) United States Patent
Kose

(10) Patent No.: US 9,867,442 B1
(45) Date of Patent: Jan. 16, 2018

(54) HEATED EYELASH COMB

(71) Applicant: Bijan Kose, West Palm Beach, FL (US)

(72) Inventor: Bijan Kose, West Palm Beach, FL (US)

( * ) Notice: Subject to any disclaimer, the term of this patent is extended or adjusted under 35 U.S.C. 154(b) by 0 days.

(21) Appl. No.: 13/783,453

(22) Filed: Mar. 4, 2013

(51) Int. Cl.

| | |
|---|---|
| ***A45D 2/48*** | (2006.01) |
| ***A45D 24/04*** | (2006.01) |
| *A45D 1/18* | (2006.01) |
| *A46B 15/00* | (2006.01) |

(52) U.S. Cl.
CPC ..... *A45D 2/48* (2013.01); *A45D 24/04* (2013.01); *A45D 1/18* (2013.01); *A46B 15/003* (2013.01); *A46B 15/0022* (2013.01)

(58) Field of Classification Search
CPC ..... A45D 2/48; A45D 40/265; A45D 1/04; A45D 7/02; A45D 1/18; A46B 15/00; A46B 15/0004; A46B 15/0022; A46B 15/003; A46B 15/0028; A46B 15/0038; A46B 11/08
See application file for complete search history.

(56) References Cited

U.S. PATENT DOCUMENTS

| | | | | |
|---|---|---|---|---|
| 2,206,365 | A * | 7/1940 | Pieper | A45D 24/04 132/139 |
| 7,322,366 | B2 | 1/2008 | Cho | |
| 7,497,218 | B2 | 3/2009 | Gueret | |
| 7,637,265 | B2 | 12/2009 | Funatsu et al. | |
| 8,267,099 | B2 * | 9/2012 | Cho | A45D 2/48 132/217 |
| 8,563,904 | B2 * | 10/2013 | Cho | 219/501 |
| 2003/0088984 | A1 * | 5/2003 | Brandt et al. | 30/34.05 |
| 2005/0150509 | A1 * | 7/2005 | Gueret | A45D 2/48 132/217 |
| 2006/0005851 | A1 * | 1/2006 | Cho | H05B 1/0252 132/217 |
| 2009/0056735 | A1 * | 3/2009 | Suh | 132/217 |
| 2009/0070947 | A1 * | 3/2009 | Baertschi et al. | 15/22.1 |
| 2010/0043817 | A1 * | 2/2010 | Haan | A45D 2/48 132/211 |
| 2011/0232671 | A1 * | 9/2011 | Bouix et al. | 132/218 |
| 2012/0305022 | A1 * | 12/2012 | Bickford | 132/218 |
| 2012/0325235 | A1 * | 12/2012 | Bouix et al. | 132/200 |
| 2013/0121745 | A1 * | 5/2013 | Tarling et al. | 401/1 |

FOREIGN PATENT DOCUMENTS

| | | | |
|---|---|---|---|
| DE | 102004026084 | A1 * | 12/2005 |
| EP | 1974627 | A1 * | 10/2008 |

* cited by examiner

*Primary Examiner* — Robyn Doan
(74) *Attorney, Agent, or Firm* — Daniel S. Polley, P.A.

(57) ABSTRACT

An eyelash comb having a heating element which allows for easier separation and reapplication of mascara on the eyelashes.

20 Claims, 5 Drawing Sheets

HEATED EYELASH COMB

1. FIELD OF THE INVENTION

The invention relates to eyelash combs.

2. BACKGROUND OF THE INVENTION

Conventional eyelash combs typically contain a handle portion and a comb portion, with the comb portion often having a plurality of parallel arranged prongs. The eyelash comb is used to separate individual eyelashes from being stuck together after the application of mascara or other substances and to distribute the mascara better and evenly to the eyelashes. The present invention provides a significant improvement over current eyelash combs.

SUMMARY OF THE INVENTION

Generally, the present invention provides for a heated eyelash comb which provides for direct contact to the eyelashes having mascara contained thereon with heated prongs which makes separating and reapplying the already applied mascara easier and reduces the risk of pulling out one or more eyelashes during separation or reapplication. The prongs are heated by a heat member which can be controlled by a switch. The heat member provides for sufficient and/or direct warming of the comb like projecting element (i.e. prongs). With the heated prongs any previously applied mascara can be softened to allow the wearer to achieve a desirable effect/result.

Mascara can contain binder substances or mixtures with low melting points such as, but not limited to, Carnauba wax (melting point between 80° C. and 87° C.) or Vaseline (melting point between 38° C. and 58° C.). Given the variances in temperature, more or less heat from the heat member may be needed in order for the prongs to be able to soften the mascara. In one embodiment of the present invention a potentiometer can be included within the electric circuitry which permits for adjustment of the temperature that the heat member can achieve. An indicating device can also alert the user to when the desired temperature has been reached and/or that the device is on. In one embodiment the comb part of the heated eyelash comb can be removably secured to the head part, wherein in another embodiment the comb part can be permanently secured to the head part.

DETAILED DESCRIPTION OF THE INVENTION

Figure 1:
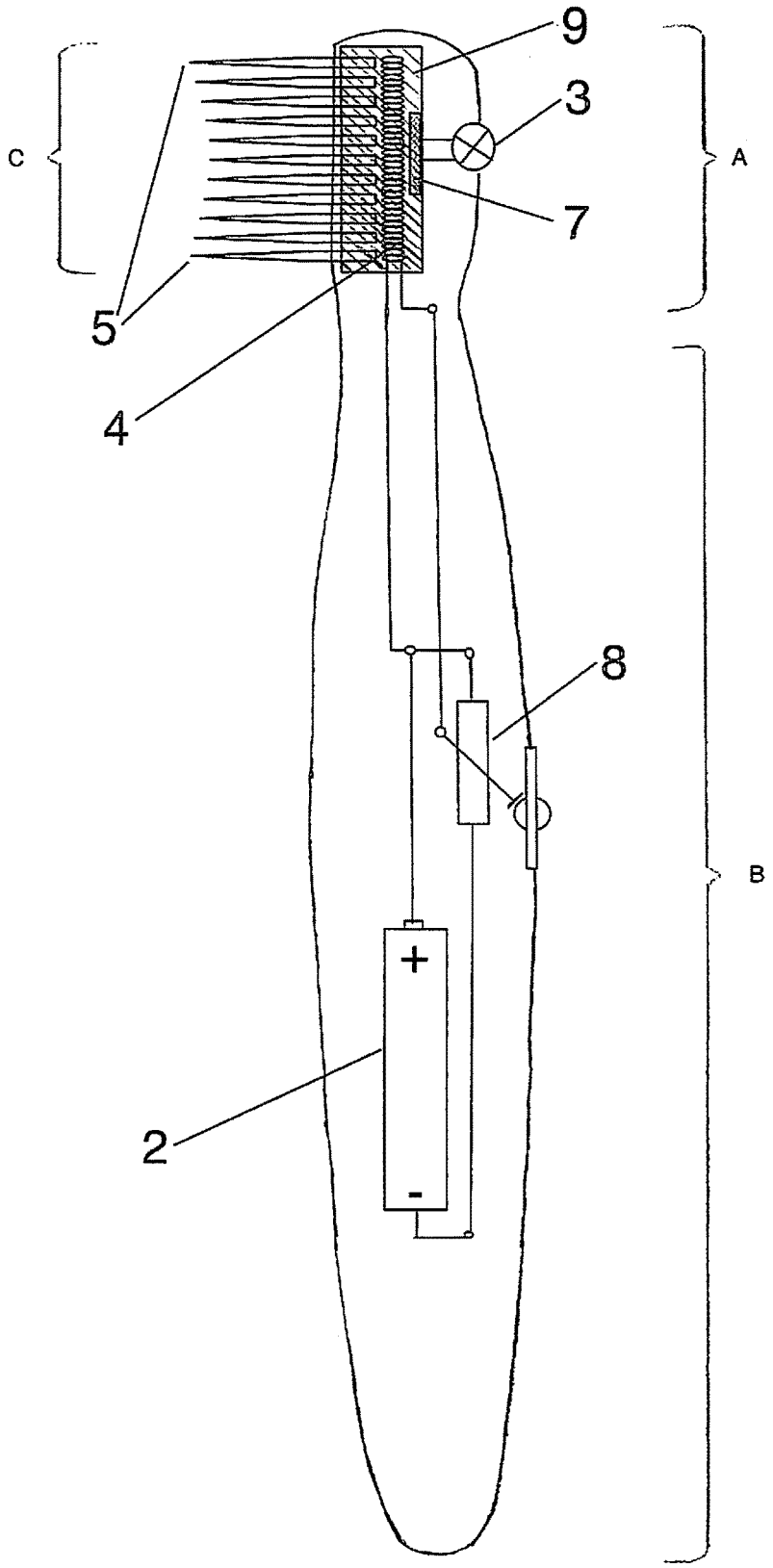
FIG. 1 is a side elevational view of the heated eyelash comb in accordance with the present invention having a portion of its housing/body removed so to permit an internal view of the heated eyelash comb.

For purposes of the below description the following parts list can include:

1=Switch
2=Power source
3=Acoustic or optical announcement indicator
4=Heating element/Heater member
5=Comb prongs
6=Shells/Sleeves
7=Electronic thermo sensor
8=Potentiometer
9=Thermo-conductive material
10=Thermo-indicating material
A=Head part
B=Handle part
C=Comb part
D=Shafts
E=Prong connecting/binding material
F=Functioning part/Exposed part of prongs.
G=Recess in the head part FIG. 1 illustrates a first embodiment for the heated eyelash comb which can include a head part A, handle part B and comb part C. In this embodiment, comb part C can be inserted within head part A and permanently or removably secured thereto. The temperature for the heated eyelash comb can be adjustable via a potentiometer 8 or any other mechanism used for temperature adjustments. A temperature sensor 7, which can be electronic, can be employed to determine when the heated eyelash comb has reached its target temperature, which can be indicated to the user including an optical sensor/display 3. In lieu of a visual display which can include a light, flashing lights, etc., the indicator could also, alternatively or additionally, be an audio indication such as one or more beeps or verbal indication. Where an audio indication is provided a speaker and sound producing technology would also be included.

Figure 2:
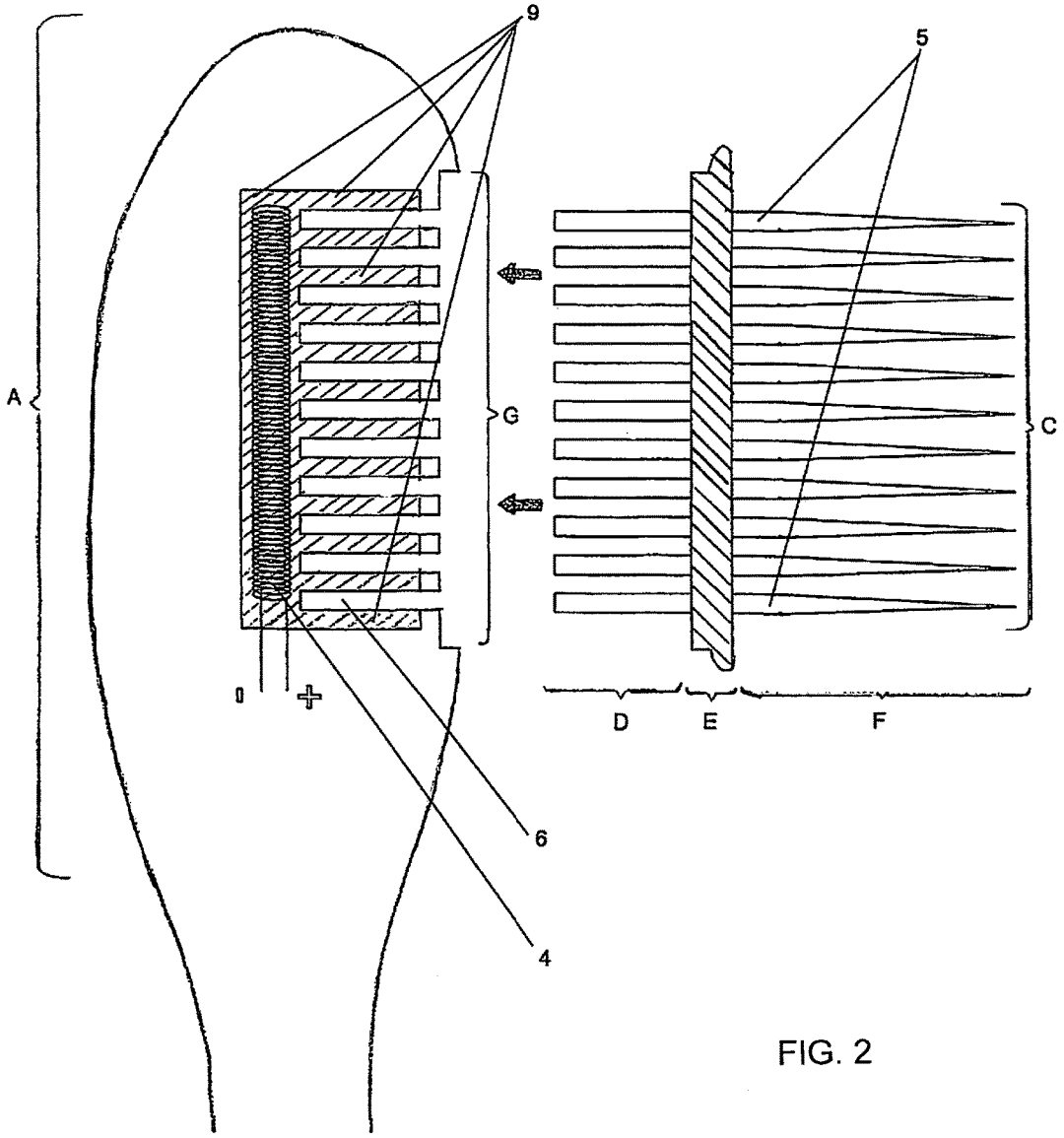
FIG. 2 is a close up exploded view of the head portion of the heated eyelash comb.

FIG. 2 illustrates an exploded of head part A and comb part C. Comb part C can comprise a plurality of attachment shafts D each having an outer end and inner end. The inner end of each attachment can be attached to one side of prong connector E. A plurality of prongs 5 are secured at one end to the other side of prong connector E. Alternatively, each attachment shaft and a corresponding prong can be one piece or monolithically formed and extends through or is otherwise connect to prong connector E by any conventional means, which permits heat to transfer from attachment shafts D to the corresponding prongs 5.

Head part A is provided within a receiving cavity having an upper recess G. Disposed within head part A is an heating element 4 which can be in communication with a thermo conductive material 9 which is also disposed within the receiving cavity of head part A. In use comb part C can be removably secured to head part A. In one securement embodiment, the attachment shafts can be inserted within the receiving cavity such that they are in communication with the thermo conductive material 9 and the ends of prong connector E can be permitted to snap or otherwise secure preferably at the recess G. In one non-limiting embodiment small openings can be provided within the recess sidewall for receipt of the ends of prong connector G, which permits the snap-fastening securement. Alternatively, a snug fit can be achieved between prong connector E and recess G during insertion. In the removable embodiments, the snap closure of the comb part C to head part A can be overcome through sufficient pulling force which causes the ends of prong connector E to be removed out of the openings in the recess sidewall.

Figure 4:
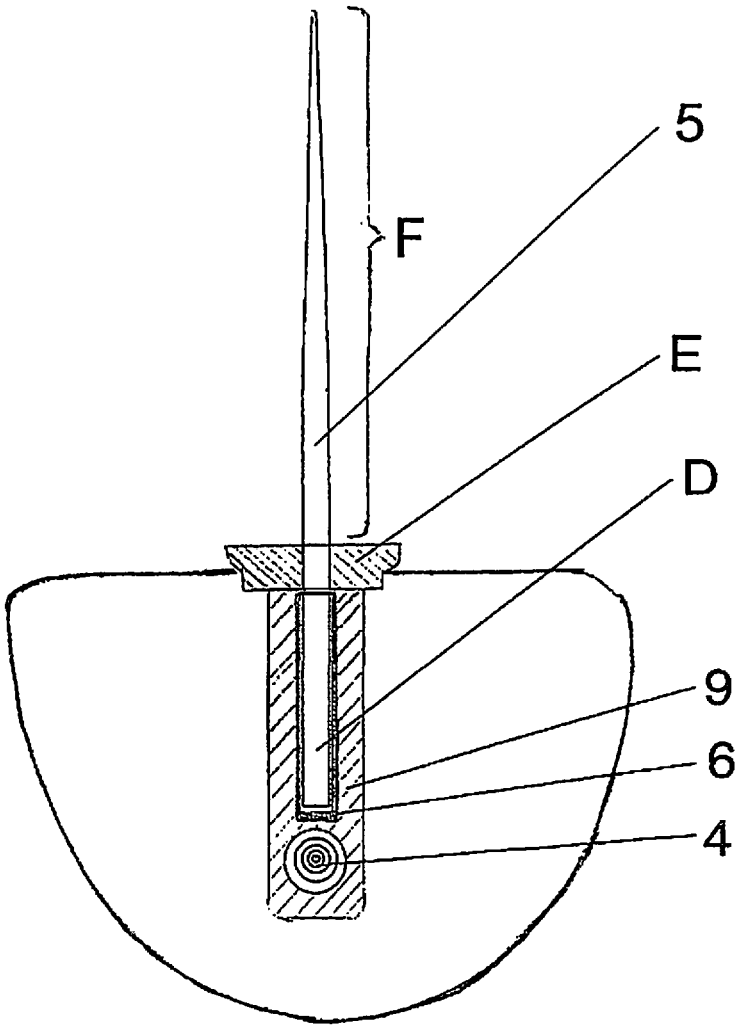
FIG. 4 is a sectional view of the head portion of the heated eyelash comb.
Figure 5:
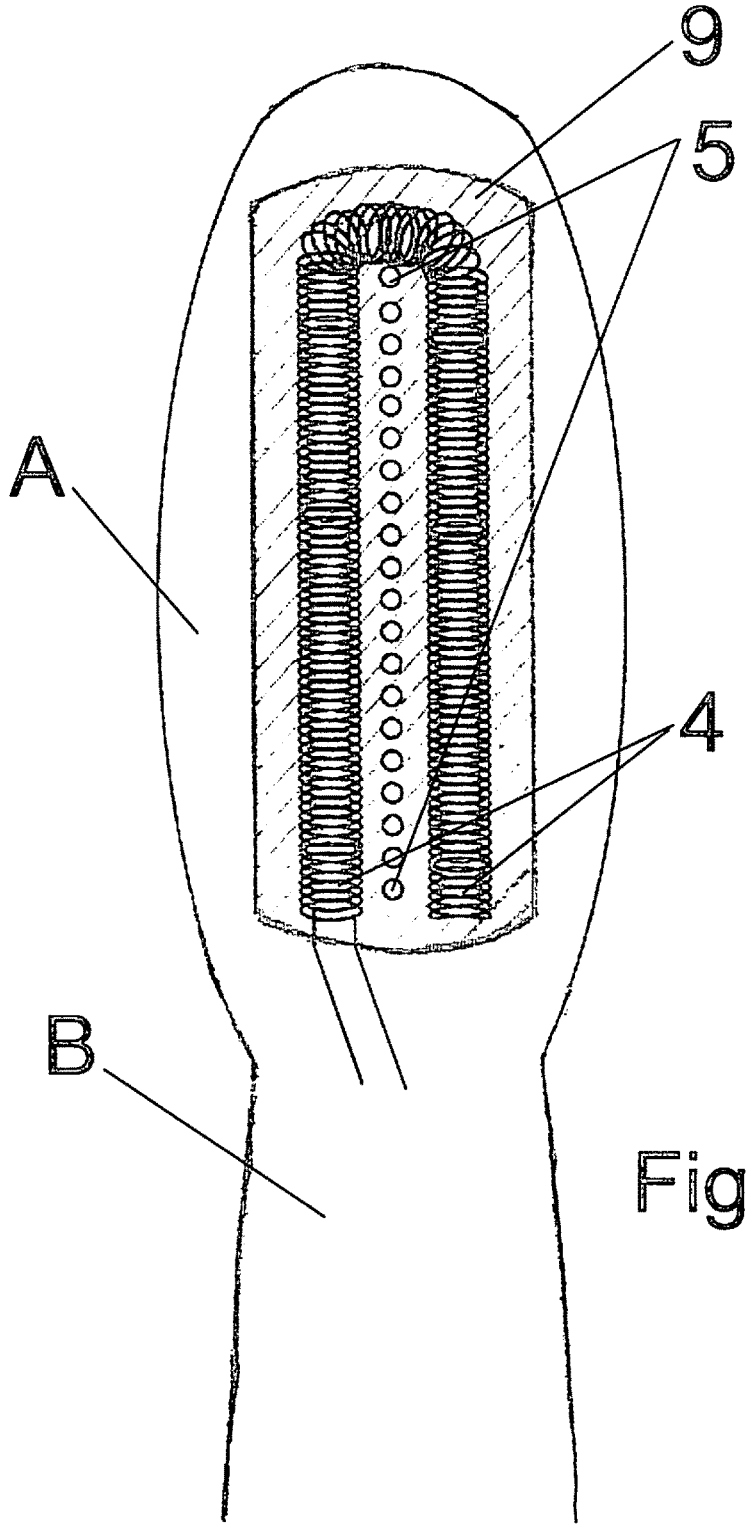
FIG. 5 is another sectional view of the head portion of the heated eyelash comb.

FIG. 4 shows a sectional view of the head part A having comb part C inserted therein and secured thereto. A heating element 4 is shown preferably disposed at a lower portion of the receiving cavity and thermo conductive material 9 is also shown filling in a portion of the receiving cavity. Heating element 4 can be located at other areas in the head part A as long as it provides the heat for heating up comb prongs 5 or F. The attachment shafts D can be in direct contact with thermo conductive material 9 and/or heating element 4. Alternatively, attachment shafts D can be located within the receiving cavity such that they are positioned close enough to thermo conductive material 9 and/or heating element 4 in order for heat to transfer to the attachments shafts D. It is also within the scope of the invention that only one or some of the attachment shafts actually receive heat from thermo conductive material 9 and/or heating element 4. In this embodiment, prong connector E can be constructed from a conductive material and can transfer heat from the heated attachment shafts D onto the attachment shafts D contained in comb part C that did not originally receive heat from thermo conductive material 9 and/or heating element 4. FIG. 5 shows heating element 4 as being substantially U-shaped and disposed around the attachment shafts from three sides. However, it should be recognized that other shapes for heating element 4 can be used and are considered within the scope of the invention. Preferably, head part A and handle B are monolithically formed or constructed integral as a one-piece member, however, such is not considering limiting.

Figure 3:
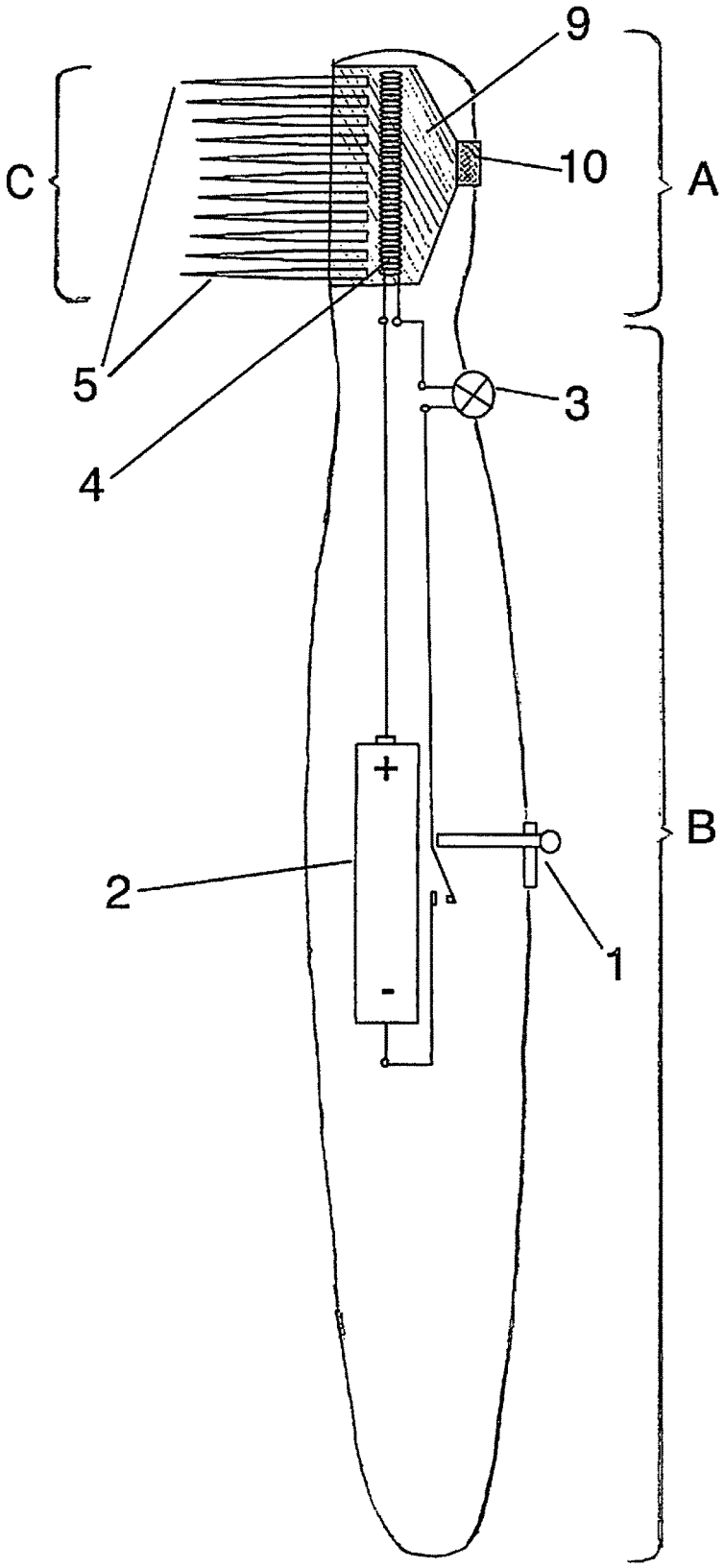
FIG. 3 is a side elevational view of another embodiment for the heated eyelash comb in accordance with the present invention having a portion of its housing/body removed so to permit an internal view of the heated eyelash comb.

FIG. 3 illustrates an on-off switch 1 as well as an electric current flow indicator 3, an optical display device 10 with a thermo-indexed piece which is preferably provided in head part A, which indicates the reaching of the set temperature, which is preferably predetermined. The actual location of these components can be at various locations on the handle or head part and all are considered within the scope of the invention.

The present invention provides the ability for thermal heating of the comb prongs 5 or F (See FIG. 4). By heating the comb prongs 5, when prongs 5 contact the mascara disposed on the user's eyelash, the binding agent of the mascara is softened and easier to comb through the lashes, with a reduced chance (if not completely without the risk) of tearing out eyelashes or unwanted clumping, peeling, or crumbling of the previously applied mascara.

With the present invention, comb prongs 5 can be directly heated by conduction through a heating element in order to reach the required/necessary temperature for softening the mascara. Comb prongs 5 are preferably not heated by radiation and convection techniques. The softening of the mascara can be primarily established by direct contact of the heated comb prongs by means of conduction. The heated prongs preferably extends all the way to the contact area of prongs 5 (i.e. pointed end, etc.) which contact the mascara for softening.

The present invention provides for heat dissipation and preferably a sufficient, if not complete, heating of the eyelashes. The mascara can be applied throughout at a relatively low heat rate such as within a range of about 40 to about 87 degrees. Furthermore, any range of values falling in between the range provided in the preceding sentence can also be used and are incorporated by reference.

The present invention overcomes the clumping problems through the preferred use of conductive, point-like fusion/softening of the mascara. Unlike radiating heating, this significantly reduces the risk of thermal irritation to the surrounding anatomic structures of the eyelashes such as the eyelid, cornea and iris, in view of the preferred low heat provided with the present invention. In addition, by direct heating of the comb prongs 5, cleaning of the eyelashes is much easier, because the warmed up mascara can be effortlessly washed or wiped off, without excessive rubbing of the eye, thus, also providing a hygienic advantage.

In the following description, the structural components of certain aspects and embodiments of the invention will be discussed. The thermo eyelash comb can comprise a head part A and a handle part B (for example see FIGS. 1 and 3). In a preferred embodiment, a switch 1 can be located in handle part B and a heating element member 4 (e.g. a heating wire, other heating mechanisms, etc.) in the head part A. The comb prongs 5 can be connected directly and indirectly through a heat conductive material 9, such as, but not limited to, a thermal conducting paste and/or a thermal conducting material (e.g. plastic) in the head part A. As head part A is connected to handle part B, through the activation of the power source 2 preferably located in handle part B, comb prongs 5 can be supplied evenly with heat energy. Thus, preferably all of comb prongs 5 are heated evenly, though such is not considered limiting. The, preferred thermal conducting paste and/or a thermal conductive plastic can be connected to or in contact/communication with heating wire 4.

Comb prongs 5 can be formed/shaped in a needle-like configuration, though such is not considered limiting. In one non-limiting embodiment, each prong 5 can have a thickness of approximately 0.5 mm and a total length of approximately 15 mm. Preferably, prongs 5 can be arranged parallel in a row. In one embodiment, the lengths of prongs 5 can be longer on the outside such that the top or peak of prongs 5 for a concave configuration (See FIG. 3). The invention is not considered limited to any size or shape of prongs or any number of prongs for comb C. In one non-limiting embodiment, a parallel row of prongs 5 can comprise between approximately five (5) to approximately thirty (30) single prongs and the distance in between adjacent prongs 5 can be anywhere between approximately 0.15 mm to approximately 0.6 mm, though such is not considered limiting.

The exposed part/functioning part F of each prong can be between approximately 3 mm to approximately 10 mm in length. The exposed part F can be defined by the visible portion of the comb prongs 5 once comb part C is secured to head part A. The exposed part F can be considered the total length of the prong 5 less the attachment shaft D portion disposed within the receiving cavity of head part A (when comb part C is secured to head part A) and less the portion of prong 5 enclosed by prong connector E. A protective cap, (not shown in the drawings) for the comb part can be provided and secured to head part A over functioning part F of prongs 5 to protect against external influences and at the same provides protection from accidental/inadvertent stabbing from the comb prongs 5 when the invention is not in use. The outer ends of prongs 5 can be needle like, dull or pointed.

An optical display/indicator 3, which in one non-limiting embodiment can be a light emitting diode ("LED"), signals that the circuit is closed and thus that heating element 4 is heating up. By contact of the heated prongs 5 to the eyelashes the binding agent of the previously applied mascara will soften, thus allowing an easy comb through, to individually separate the eyelashes, which at least reduces the danger of "tearing out of lashes" or other unintentional or undesirable clumping, peeling and/or crumbling of the previously applied mascara.

In one embodiment of the invention, the range or temperature of heating element 4 can be monitored and/or sensed by an electronic temperature sensor 7 which, upon reaching the desired temperature, can cause a visual/optical 3 and/or acoustic/audio display/announcement to activate (i.e. light up, produce a sound, etc.), thus signaling the achievement of the set/ideal/desired temperature. In an alternative embodiment (See FIG. 3), a thermo-indicating material (e.g. plastic, paste, etc.) or thermo indicating color 10 for the same purpose (alert that the desired or predetermined temperature has been reached) can be provided. Preferably, indicator 10 can be located in the area of the heating element 4, and can provide indication through a color change when it reaches the desired temperature, which is visible through a window or opening in head part A.

In another embodiment, a power supply can be continuously adjustable/variable by a potentiometer 8 (See FIG. 1). By being able to adjust the power through potentiometer, results in the temperature of heating element 4 to also be variable/adjustable. One use for adjusting the temperature of heating element 4 is that different mascara may have different melting points and thus, the present invention permits fine tuning or adjustment of the necessary temperature in accordance with the mascara type to which prongs 5 of comb part C will come into contact with.

Though comb part C can be permanently secured to head part A, it is also within the scope of the invention to design comb part C to be removable and interchangeable with head part A which can be considered a shell/hub for receipt of comb part C. Furthermore, it is also within the scope of the invention to have the head part removably secured to the handle. The shells or hub (FIGS. 2 and 4) of head part A can include the receiving cavity can be heated directly or indirectly via a heat conductive material contained within the receiving cavity, such as thermal conducting paste or a thermal conductive material 9 (e.g. plastic, paste, etc.). As best seen in FIG. 4, the conductive paste/material 9 can be in direct communication/contact with heating element 4. The receiving cavity receives the prong shafts D which are held firmly in place within the receiving cavity via snap-fastening connection of prong connector E with the shell/hub of head part A to fixate and anchor shafts D securely within and to head part A. A slide-type fastener could alternatively be used or be provided in addition to the snap-type fastener.

Prongs connector E of removable/detachable comb part C can be made from a suitable material to be fixated in conjunction with recess G to head part A, such that prong shafts D are securely anchored or positioned in head part A (i.e. within the receiving cavity). Heating element 4 can be below prong shafts D, or arranged around them, or in any other position which permits prongs 5 to become heated.

Furthermore, it is also possible to use several independent heating elements 4. In either case, a connection between the prongs 5 and the heating elements 4 through thermo-conducting material 9, which enables a conductive heat transfer and/or direct contact between the heating element and prongs can be used. As another non-limiting option, heating element 4 can be used as a self-regulating Positive Temperature Coefficient (PCT), which can be barium titanate-ceramic bodies that are pressed either in disc, rod or tube form and are encased/enclosed in metal. With the use of the PCT, comb prongs 5 could be soldered directly with/to the metal capsule or can be welded or otherwise secured together, and therefore provide an improved effective heat conduction for the comb part C.

The thermo-conducting material 9 can be shaped so as to form slot or openings 6 for received a corresponding one of the attachment shafts D, such as in a female/male attachment relationship. The heating element select is not limited to any particular embodiment, and can be any conventional heating component used to provide heat.

In lieu or addition to a battery power source, the heated eyelash comb can also be provided with an electrical cord to plug in the heated eyelash comb. The plugging in of the electrical could also be used to recharge the battery, where a rechargeable battery is provided as one of the power sources. Additionally, the heated eyelash comb can be provided with a charging base, to charge the battery within the comb's housing. The base can be provided with a cavity for receipt of the bottom (non-prong end) of the heated eyelash comb which creates an electronic connection between the charging base and heated eyelash comb.

As a non-limiting example, the comb and the base can form a two-part transformer, with the base having a first part of the transformer and the heated eyelash comb containing the second part. The charging base can be connected with a wall outlet through an associated electrical cord. When the heated eyelash comb is slid or otherwise connected onto the charging base, the transformer circuitry is created which permits the charge to flow. The charging base can be provided with one of the coils and a metal bar and the heated eyelash comb can be provided with the second coil. Other electronic charging configurations, circuitry and/or components can be used and are also considered within the scope of the invention.

It is also within the scope of the invention that the present invention device be used and configured only as an heated eyelash comb/eyelash comb and not have any other features incorporated with or added to the device for other additional uses.

All measurements, amounts, values, sizes, shapes, percentages, materials, configurations, securement mechanisms, sealing members, sensing members, components, orientations, etc. discussed above or shown in the drawing figures are merely by way of example and are not considered limiting and other measurements, amounts, values, sizes, shapes, percentages, materials, configurations, securement mechanisms, sealing members, sensing members, components, orientations etc. can be chosen and used and all are considered within the scope of the invention.

Various types of heating elements can be used within head part A and all are considered within the scope of the invention. Various types of removable securement connections can be used to removably secure comb part C to head part A.

Some of the features and characteristics ("Feature") of the present invention can include, but are not limited to:

Feature 1. Eyelash comb with one head part (A), therein containing a comb part (C), consisting of single row, parallel arranged, heat-conducting prongs (5), which are connected with at least one heat element (4) and are connected through heat-conduction, and a handle part (B) with a power source (2), which is activated by a power switch (1) thus supplying electric power to the whole heat element(s) (4).

Feature 2. Eyelash comb according to feature 1 wherein the one or more heat element(s) (4) are self-regulating Barium titanate-ceramic bodies PTC heating elements.

Feature 3. Eyelash comb according to feature 1, wherein the switch (1) is a potentiometer (8) with a power off switch.

Feature 4. Eyelash comb according to features 1, 2 and 3, characterized in that it has a visual and or acoustic indicator (3), which indicates/signals the closed circuit.

Feature 5. Eyelash comb according to features 1-3 wherein the head part (A) contains a thermo-indicating material (10), which signals a temperature change of the comb part/member (C).

Feature 6. Eyelash comb according to features 1-3 characterized in that the head part (A) contains an electronic thermal sensor (7), whereby upon reaching a set temperature of the comb part (C) within the head part (a) are signaled visually and/or acoustically (3).

Feature 7. Eyelash comb according to features 1-3 characterized in that the head part (A) is coated/covered with a thermo-indicating color (10), which signals a temperature change of the comb part (C).

Feature 8. Eyelash comb according to features 1 and 3-6, wherein a potentiometer is located in the eclectic circuit, to set the manufacture recommended power supply.

Feature 9. Eyelash comb according to features 1-8 wherein the thermal element (4) is arranged in a single row beside or below the row of the comb shafts (D) and the shells (6).

Feature 10. Eyelash comb according to features 1-8 wherein the thermo heating elements (4) are at least two-rowed and in at least in one level arranged around the comb shafts (D).

Feature 11. Eyelash comb according to feature 10 wherein the power source is at least one disposable battery.

Feature 12. Eyelash comb according to features 1-11 characterized in that the power source is rechargeable.

Feature 13. Eyelash comb according to features 1-12 characterized in that the comb prongs (5) are made out of a material with a high heat conduction purpose.

Furthermore, one or more features or characteristics discussed for one embodiment of the present invention can also be used with another of the above discussed embodiments of the present invention.

The comb prongs are preferably constructed from a conductive material.

Unless feature(s) or characteristic(s) described in the specification or shown in the drawings for a claim element or claim term specifically appear in the claim with the claim element or claim term, then the inventor does not consider such feature(s) or characteristic(s) to be included for the claim element or claim term in the claim when and if the claim element or claim term is interpreted or construed.

While the invention has been described and disclosed in certain terms and has disclosed certain embodiments or modifications, persons skilled in the art who have acquainted themselves with the invention, will appreciate that it is not necessarily limited by such terms, nor to the specific embodiments and modification disclosed herein. Thus, a wide variety of alternatives, suggested by the teachings herein, can be practiced without departing from the spirit of the invention, and rights to such alternatives are particularly reserved and considered within the scope of the invention.

What is claimed is:

1. A heated eyelash comb, comprising:

a head part;

a comb part secured to said head part and having a plurality of heat conducting prongs, wherein each heat conducting prong includes a corresponding prong shaft, an elongated prong connector continuously extending across each of the conducting prongs and spaces therebetween at an intermediate position along each of the plurality of heat conducting prongs such that a first end of each of the plurality of heat conducting prongs extend out of a first side of the prong connector and a second end of each of the plurality of heat conducting prongs extend out of a second opposite side of the prong connector, wherein the elongated prong connector is positioned substantially perpendicular to each of the plurality of heat conducting prongs;

a handle part secured to said head part;

heating circuitry including a switch, a power source and one or more heating elements, said one or more heating elements adjacent to the heat conducting prongs for directly or indirectly heating said heat-conducting prongs;

wherein upon turning the switch to an "on" position, said power source supplies electric power to the one or more heating elements which heats up the heat conducting prongs.

2. The heated eyelash comb of claim 1 wherein the one or more heating elements are self-regulating Barium titanate-ceramic bodies PTC heating elements.

3. The heated eyelash comb of claim 1 wherein the switch is a potentiometer in communication with a power on/off switch.

4. The heated eyelash comb of claim 1 further comprising a visual or acoustic indicator in communication with the heating circuitry which indicates when the heating circuitry is closed and supplying power to the one or more heating elements.

5. The heated eyelash comb of claim 1 further comprising a thermo-indicating material disposed within the head part and partially visible through an opening or window in the head part, said thermo-indicating material signaling a temperature change of the comb part.

6. The heated eyelash comb of claim 1 further comprising an electronic thermal sensor associated with the head part and providing a visual or audio signal when a set temperature for the comb part has been reached.

7. The heated eyelash comb of claim 1 wherein at least a portion of said head part is coated or covered with a thermo-indicating color for use in signalling a temperature change of the comb part.

8. The heated eyelash comb of claim 1 wherein said heating circuitry further comprising a potentiometer for setting the power source.

9. The heated eyelash comb according to claim 1 wherein the heating element is disposed within the head part and arranged beside or below the prong shafts.

10. The heated eyelash comb according to claim 9 wherein said heating elements is substantially U-shaped and disposed around the prong shafts on three sides.

11. The heated eyelash comb of claim 1 wherein the power source is at least one battery internally disposed within the handle part.

12. The heated eyelash comb of claim 1 wherein the power source is at least one rechargeable battery internally disposed within the handle part.

13. The heated eyelash comb of claim 1 wherein said prongs are constructed from a high heat conduction material.

14. The heated eyelash comb of claim 1 wherein said comb part is removably secured to said head part.

15. A heated eyelash comb, comprising:

a head part having a plurality of receiving cavities and an upper recess;

a comb part having at least one row of parallel spaced apart heat conducting prongs, wherein each heat conducting prong includes a corresponding prong shaft, a prong connector continuously extending along each of the conducting prongs and spaces there between and wherein the prong connector is positioned between each of the conducting prongs and its corresponding prong shaft, when the comb part is secured to the head part, each of said corresponding prong shafts is inserted into a corresponding one of the plurality of receiving cavities such that said prong connector is secured at the upper recess;

each of said conducting prongs is constructed from a high heat conduction material;

a handle part secured to said head part;

heating circuitry including a switch associated with the handle part, a power source disposed internally within the handle part or the head part and a potentiometer disposed within said handle part and one or more heating elements disposed within said head part, a thermo conductive member disposed within said head part and in contact with the one or more heating elements and in contact with the plurality of prong shafts;

wherein said one or more heating elements in communication with said heat-conducting prongs through heat conduction;

wherein upon turning the switch to an "on" position, said power source supplies electric power to the one or more heating elements which through the thermo conductive member and the plurality of prong shafts heat up the at least one row of heat conducting prongs;

wherein said potentiometer permits adjustment of the amount of power supplied to the heating element to control the temperature to which the prongs are heated to.

16. The heated eyelash comb of claim 15 further comprising a visual or acoustic indicator in communication with the heating circuitry which indicates when the heating circuitry is closed and supplying power to the one or more heating elements.

17. The heated eyelash comb of claim 15 further comprising a thermo-indicating material disposed within the head part and partially visible through an opening or window in the head part for signaling a temperature change of the comb part or at least a portion of said head part is coated or covered with a thermo-indicating color for use in signaling a temperature change of the comb part.

18. The heated eyelash comb of claim 15 further comprising an electronic thermal sensor associated with the head part and providing a visual or audio signal when a set temperature for the comb part has been reached.

19. The heated eyelash comb of claim 15 wherein said comb part is removably secured to said head part through a snap connection between a first end and a second end of the prong connector and a recess portion of the head part.

20. A heated eyelash comb, comprising:

a head part having a plurality of receiving cavities and an upper recess;

a comb part having at least one row of parallel spaced apart heat conducting prongs, wherein each heat conducting prong includes a corresponding prong shaft, a prong connector continuously extending along each of the conducting prongs and spaces there between and wherein the prong connector is positioned between each of the conducting prongs and its corresponding prong shaft, when the comb part is secured to the head part, each of said corresponding prong shafts is inserted into a corresponding one of the plurality of receiving cavities such that said prong connector is secured at the upper recess;

each of said conducting prongs is constructed from a high heat conduction material a handle part secured to said head part;

heating circuitry including a switch associated with the handle part, a power source disposed internally within the handle part or the head part and one or more heating elements disposed within said head part, wherein upon turning the switch to an "on" position, said power source supplies electric power to the one or more heating elements and the plurality of prong shafts heat up the at least one row of heat conducting prongs.

* * * * *